US006460198B1

(12) United States Patent
Dilworth, Jr. et al.

(10) Patent No.: US 6,460,198 B1
(45) Date of Patent: Oct. 8, 2002

(54) BARRIER GARMENT SYSTEM

(75) Inventors: Curtis Dilworth, Jr., Decatur; Daniel Raiford, Suwanee, both of GA (US)

(73) Assignee: Gocurda, LLC, Suwanee, GA (US)

( * ) Notice: Subject to any disclaimer, the term of this patent is extended or adjusted under 35 U.S.C. 154(b) by 0 days.

(21) Appl. No.: 09/536,658

(22) Filed: Mar. 28, 2000

(51) Int. Cl.[7] ..... A41D 13/00
(52) U.S. Cl. ..... 2/457; 2/901; 2/84; 2/246
(58) Field of Search ..... 2/84, 901, 51, 2/900, 246, 244, 457, 79, 83, 94, 115, 456, 424, 106, 69, 202; 128/201.29, 201.23, 202.19, 206.28

(56) References Cited

U.S. PATENT DOCUMENTS

| | | | | | |
|---|---|---|---|---|---|
| 3,015,107 | A | | 1/1962 | Lippman | |
| 3,423,763 | A | | 1/1969 | Schwartz | |
| 4,466,137 | A | * | 8/1984 | Carnaghi | 2/237 |
| 4,791,681 | A | | 12/1988 | Dean | |
| 4,845,779 | A | * | 7/1989 | Wheeler et al. | 2/84 |
| 4,932,078 | A | | 6/1990 | Jones et al. | |
| 4,969,214 | A | * | 11/1990 | Cohen | 2/94 |
| 5,005,216 | A | * | 4/1991 | Blackburn et al. | 2/79 |
| 5,027,438 | A | * | 7/1991 | Schwarze et al. | 2/82 |
| 5,142,704 | A | * | 9/1992 | Viemeister et al. | 2/202 |
| 5,214,797 | A | * | 6/1993 | Tisdale | 2/84 |
| 5,411,017 | A | | 5/1995 | Wong | |
| 5,535,447 | A | * | 7/1996 | Stevens et al. | 2/84 |
| 5,586,339 | A | * | 12/1996 | Lathan | 2/79 |
| 5,918,314 | A | * | 7/1999 | Moses | 2/79 |
| 5,920,903 | A | * | 7/1999 | Koehntop et al. | 2/69 |
| 5,924,131 | A | * | 7/1999 | Wilkinson | 2/69 |
| 5,991,921 | A | * | 11/1999 | Saito | 2/69 |

FOREIGN PATENT DOCUMENTS

WO WO 89/08994 10/1989

OTHER PUBLICATIONS

Recommended Infection–Control Practices for Dentistry, 1993, published by the U.S. Department of Health and Human Services on May 28, 1993, pp. 67–69 and 75.

* cited by examiner

*Primary Examiner*—Amy B. Vanatta
(74) *Attorney, Agent, or Firm*—Bernstein & Associates, P.C.; Jason A. Bernstein

(57) ABSTRACT

A garment system for healthcare providers including pants, a shirt, and a hood that provides a protective barrier against infectious materials in body fluids and that is adapted for use in field operating and/or uniformed organizations such as the military, United Nations healthcare organizations, and other internationally serving healthcare providers.

17 Claims, 3 Drawing Sheets

BARRIER GARMENT SYSTEM

FIELD OF THE INVENTION

The present invention relates generally to apparel for healthcare providers and, more particularly, to barrier garments for healthcare provider personnel who work in a field environment and/or in uniformed organizations such as the military.

BACKGROUND OF THE INVENTION

In hospitals, clinics, and the like in the United States, healthcare providers such as physicians, dentists, veterinarians, nurses, paramedics, ancillary healthcare personnel, and the like are required by the Occupational Safety and Health Administration (OSHA) of the U.S. Department of Labor to wear barrier garments such as gowns or scrubs. These barrier garments are required to prevent the healthcare provider from being exposed to potentially infectious material in body fluids from the patients they treat, and vice versa. Additionally, OSHA requirements do not permit healthcare providers to practice in the same clothes that they wear when not practicing. Clothing used as barrier garments are not allowed to come into contact with the general public outside the use area. The barrier garments must therefore generally be taken off immediately after a single use and laundered or discarded.

These requirements are necessary to prevent the exposure of other persons to potentially infectious materials such as hepatitis B, Acquired Immune Deficiency Syndrome (AIDS), and other bloodborne pathogens in body fluids such as blood, saliva, and other oral and respiratory fluids. These OSHA requirements are provided at least in part in *Occupational Exposure to Bloodborne Pathogens*; Final Rule, 29 C.F.R. Part 1910.1030 (Dec. 6, 1991), and in *Controlling Occupational Exposure to Bloodborne Pathogens in Dentistry*, published as OSHA 3129 by the U.S. Department of Labor in 1992.

However, healthcare providers in uniformed organizations such as the U.S. military branches, paramedics, "Flying Doctors of America," United Nations healthcare providers, humanitarian organizations, "Doctors Without Borders," other internationally serving healthcare providers, and the like that practice in countries other that the U.S. and/or that practice in the field or in combat situations are required by such organizations to wear apparel approved by and consistent with the uniform requirements of the organizations. For example, healthcare providers in the military are required to always wear "Battle Dress Uniforms" (BDUs) in accordance with uniform protocol, which BDUs do not provide protection from potentially infectious materials in body fluids. As a result, healthcare providers in these situations often practice in the same clothing in which they eat, socialize, and sometimes sleep. As their BDUs are often splattered with blood and other body fluids after providing field and combat treatment, there is significantly increased the exposure to themselves and others of infectious materials.

Accordingly, what is needed but not found in the prior art is a garment for healthcare providers that provides a protective barrier against infectious materials in body fluids and that is adapted for use in uniformed organizations such as the military and that is capable of being resterilized or throw away.

SUMMARY OF THE INVENTION

Accordingly, the present invention overcomes the deficiencies of the prior art by providing a garment system for healthcare providers that provides a protective barrier against infectious materials in body fluids, semi-fluids, and aerosols, and is adapted for use in uniformed organizations such as the military. Generally described, the present invention comprises pants or other means for substantially covering a person's lower body, a shirt or other means for substantially covering a person' upper body, and a hood or other means for substantially covering a person's head. The pants, shirt and hood form a generally contiguous barrier protecting the wearer from infectious materials in body fluids. The garments may have a pattern in compliance with uniform requirements of an organization, such as camouflage for the military or indicia printed thereon.

The pants may have leg bottoms that can be cinched by any of various means at the ankles and tucked into a wearer's boots, a variety of size and arrangement of pockets, and a waistband with a drawstring and/or or belt loops. The shirt may have short, medium, or long arm sleeves with ends that can be cinched by any of various means at the wrists, a bottom section that overlaps with the pants waist, and a variety of size and arrangement of pockets. The shirt may also have organizational insignia such as "U.S. Army" or a unit crest sewn or otherwise fixedly attached to the shirt, and personal insignia such as the wearer's name and rank removably attached to the shirt by hook and loop fasteners, pins, snaps, buttons, or the like. The personal insignia may thus be removed from the shirt which allows for bulk laundering of the garments, for example, laundering of an entire military medical unit's apparel, and redistribution of the garments by size requests from the unit members without having to sort the garments by name.

The hood may have a generally translucent face shield made of a generally flexible material, such as a clear plastic. One or more openings may be provided in the hood for ventilation and sound transmission. One or more couplings, such as hook and loop fasteners, may be provided for detachably connecting the hood to the shirt, so that the hood can be detached from the shirt and, for example, stored in one of the pants or shirt pockets.

These and other objects, features, and advantages of the present invention are discussed or apparent in the following detailed description of the invention, in conjunction with the accompanying drawings and the appended claims.

BRIEF DESCRIPTION OF THE DRAWINGS

The various features and advantages of the invention will be apparent from the attached drawings, in which like reference characters designate the same or similar parts throughout the figures, and in which.

DETAILED DESCRIPTION OF ONE EMBODIMENT OF THE INVENTION

Referring now to FIGS. 1–4, there is illustrated one of many possible embodiments of the present garment system. There is provided pants 10, a shirt 12, and a hood 14, each made of material such as a cloth, a synthetic fabric, paper or paper-like material for single use garment applications, or another known material that may act as a barrier to fluids. The material may be selected for durability and laundering to provide for reuse of the garments or for lower cost to provide for disposal after a single use. Many suitable single layer and laminate materials have been developed which act as fluid barriers and which provide for ventilation and comfort, such as those fabrics available from Kimberly Clark Corporation, Neenah, Wis.

It will be understood by those skilled in the art that the garments can be provided by the component parts of pants 10, the shirt 12, and the hood 14 combined, that each component 10, 12, and 14 can be provided and used individually and/or in conjunction with other garments, that the garments can be provided specifically for use by men, women, or both, and that the garments can be provided by a unitary garment such as a jumpsuit, gown, robe, dress, or the like. When used in conjunction with gloves and boots or the like, the garment system provides full body protection to the wearer from exposure to infectious material in body fluids. Also, the pants 10, shirt 12, and hood 14 may be worn over conventional uniforms, undergarments, or other garments, or may be worn alone.

The pants 10, shirt 12, and hood 14 may have a surface pattern or design confirming to the uniform requirements of an organization. Such patterns may include camouflage, United Nations blue, Desert Storm sand color, khaki, and/or the like. The garments may thus be worn as a uniform in compliance with organizational requirements while also providing the wearer protection against infectious materials in body fluids.

Figure 1:
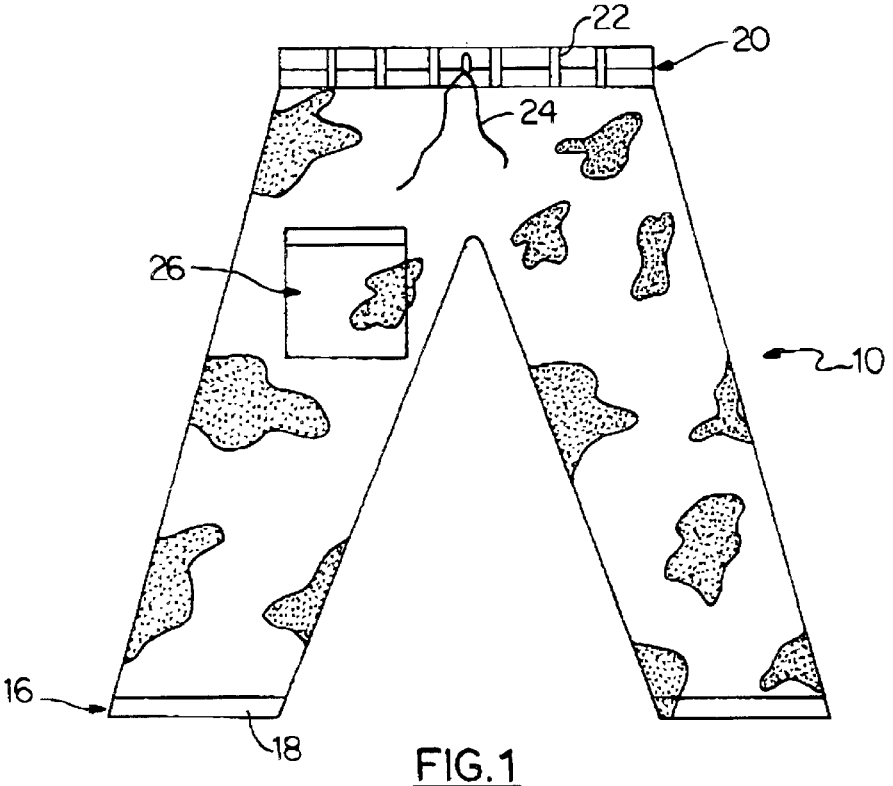
FIG. 1 is a front view of the pants of one embodiment of the present garment system invention.
Figure 2:
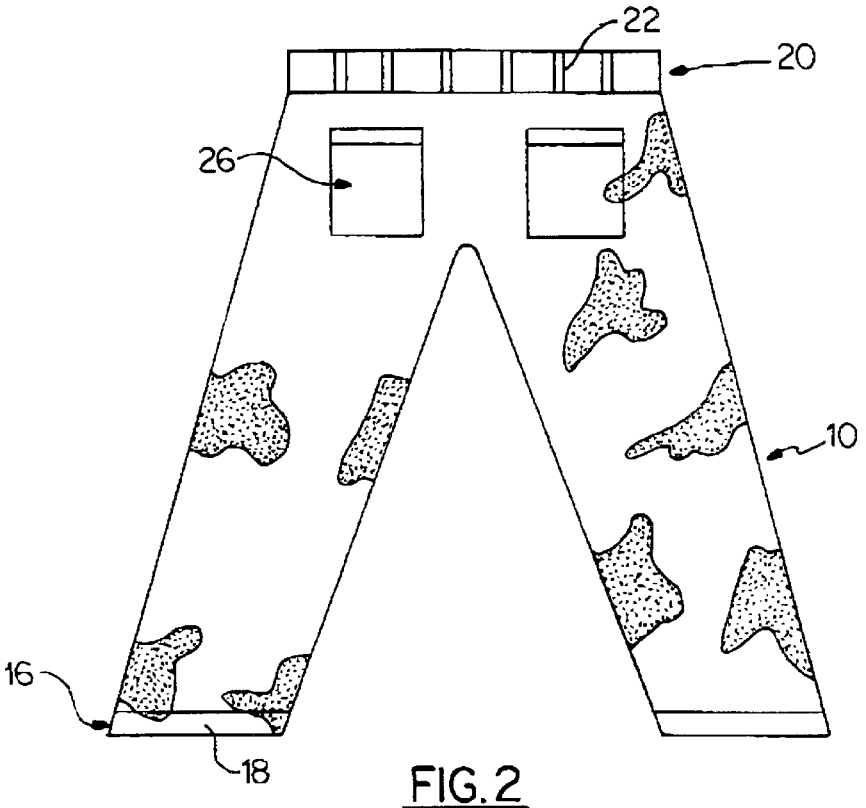
FIG. 2 is a rear view of the pants of FIG. 1.

Referring now to FIGS. 1 and 2, there is illustrated the pants 10, which may be provided in sizes such as small, medium, large, and the like for corresponding to a wearer's lower body size. The pants 10 may have an elongated bottom section 16 for tucking into the wearer's boots or the like. The bottom section 16 may have a strap 18 or the like with a buckle, snap, hook and loop fasteners, or the like for adjustably conforming the bottom section 16 to the wearer's ankles to prevent fluids from contacting the wearer. The pants 10 have a waist 20 with belt loops 22 for receiving therethrough a conventional belt, a drawstring 24 for tightening of the waist, an elastic waistband, or other waistbands known to those skilled in the art. Additionally, the pants 10 may have at least one pocket 26 such as two rear pockets and/or a front cargo pocket, with or without cover flaps. It will be understood by those skilled in the art that the pants 10 can be provided by any means for substantially covering a wearer's lower body, including a skirt, shorts, jumpsuit, gown, robe, dress, or the like.

Figure 3:
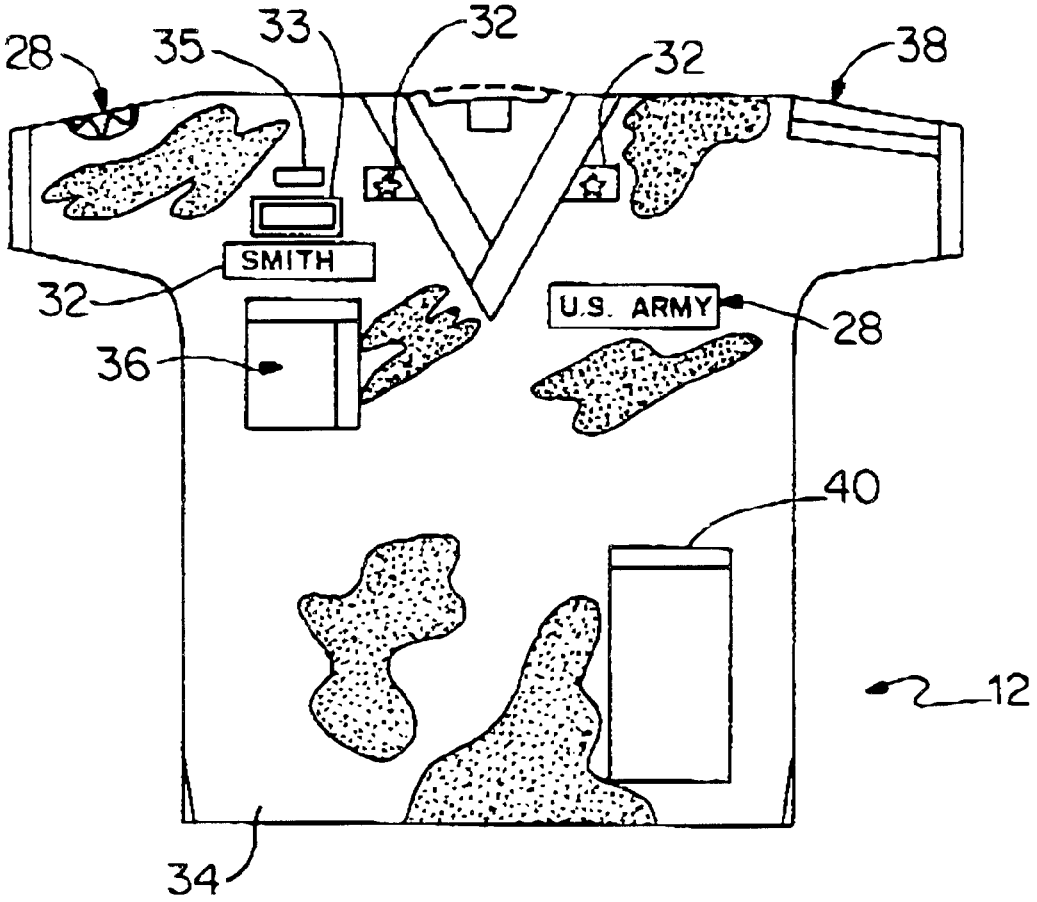
FIG. 3 is a front view of the shirt of the embodiment.

Referring now to FIG. 3, there is illustrated the shirt 14, which may be provided in sizes such as small, medium, large, extra-large, and the like for corresponding to a wearer's upper body size. The shirt 12 may have organizational insignia 30 such as the name of the organization (e.g., "U.S. Army"), a unit crest (e.g., insignia for a medical group of the organization), or other organizational insignia fixedly attached to the shirt by sewing or other attachment methods known to those skilled in the art. Also, the shirt may have personal insignia 32 such as the wearer's name and rank removably attached to the shirt 12 by hook and loop fasteners, snaps, buttons, zippers, or other removable attachment mechanisms known to those skilled in the art. The personal insignia 32 can thus be removed from the shirt 12 after use and a plurality of shirts 12, pants 10, and hoods 14 can be laundered in bulk and redistributed according to size requests from the healthcare providers without having to sort the garments by the providers' names.

Additionally, there may be provided a generally translucent sheet 33 of a material such as plastic or another known material attached to the shirt 12 by sewing or other known methods. At least one side of the translucent sheet 33 is open for removably receiving between the sheet 33 and the shirt 12 a name badge or the like therein so that the badge can be viewed through the translucent sheet 33. Furthermore, a strip 35 of a material such as a fabric, plastic, or other known material may be attached to the shirt 12 by sewing or other known methods. For example, the ends of the strip 35 can attached to the shirt 12 so that a middle portion of the strip 35 is available for easy attachment and detachment thereto by a clip of a conventional clip-on name badge or the like. The translucent sheet 33 and/or the strip 35 thus provide for easily attaching and detaching a name badge or the like to the shirt 12 for organizations where proper identification, security clearances, and the like may be required. The sheet 33 and/or strip 35 may be advantageously positioned on the front chest portion of the shirt 12, for example, above a chest pocket where name badges are commonly worn, for easy viewing thereof.

The shirt 12 may also have an elongated bottom section 34, for example, about an extra two inches of length, for overlapping with the pants waist 20 to provide sufficient slack for the wearing thereover of gear such as a military web belt supporting a canteen, sidearm or the like. The shirt 12 may have short sleeves, medium sleeves, or long sleeves with fasteners such as buttons, snaps, hook and loop fasteners, or the like for securing in place a rolled-up sleeve. The shirt 12 may also have sleeve ends with fasteners such as buttons, snaps, hook and loop fasteners, or the like for adjustably conforming to the wearer's wrists. Also, the shirt 12 may have at least one chest pocket 36, at least one sleeve pocket 38 for pencils or the like, and at least one utility pocket 40 elongated for holding a stethoscope, flashlight, or the like, with or without cover flaps. It will be understood by those skilled in the art that the shirt 12 can be provided by any means for substantially covering a wearer's upper body, including a blouse, jacket, jumpsuit, gown, robe, dress, or the like.

Figure 4:
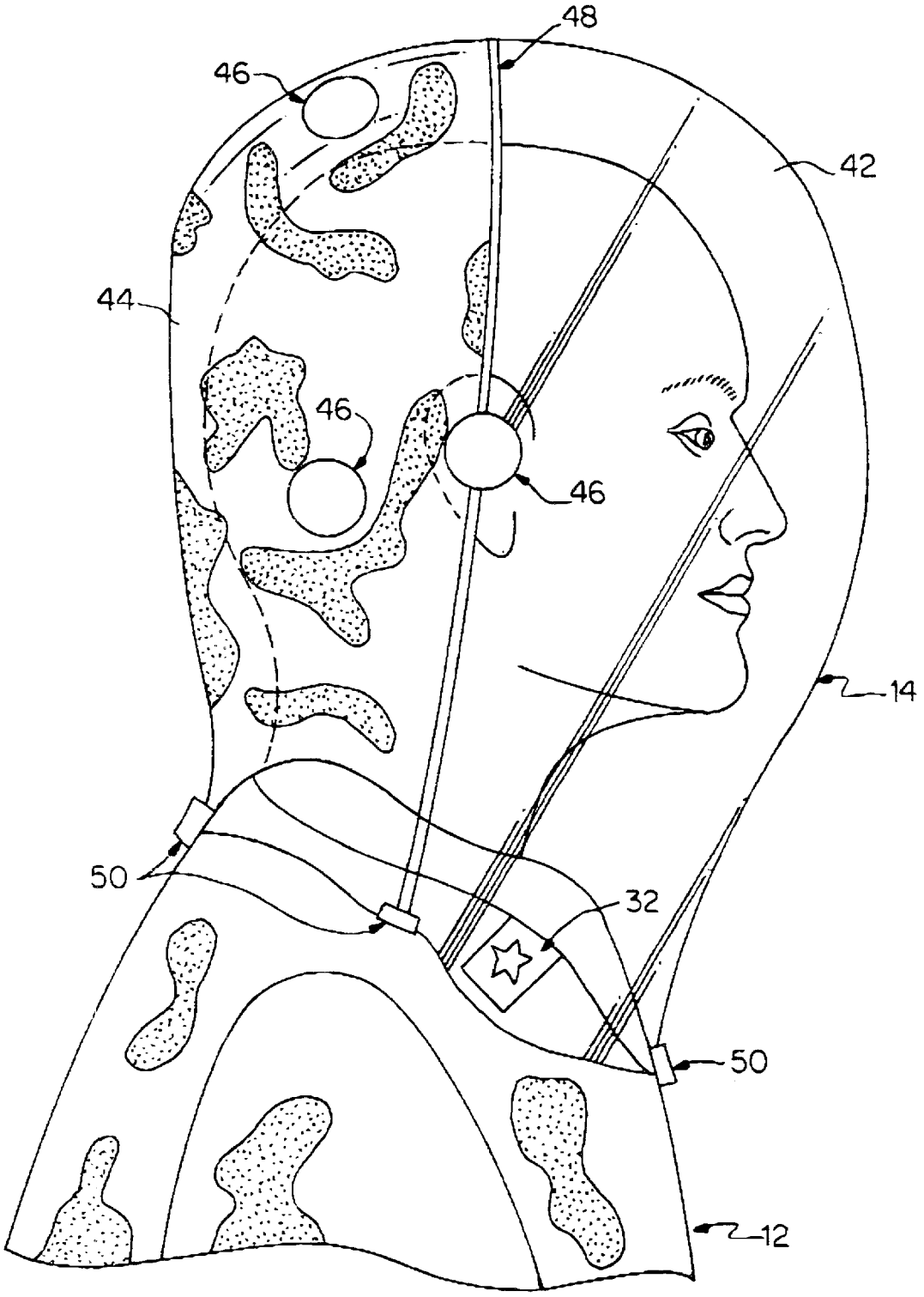
FIG. 4 is a side view of the hood of the embodiment.

Referring now to FIG. 4, there is illustrated the hood 14 which substantially covers the wearer's head, The hood 14 has a face shield 42 made of a generally translucent and flexible material such as clear plastic or another material known to those skilled in the art. The face shield protects the wearer's face from blood and other fluid splatter while providing healthcare treatment. A non-front portion 44 of the hood 14, such as a side, rear, or top, may be made of the same material as the pants 10 and shirt 12 or of disposable material such a paper or the like. The non-front portion 44 has at least one opening 46 defined therein to permit airflow into and out of the hood 16 for preventing fogging of the face shield 42. For example, there may be provided two openings 46 generally adjacent the wearer's ears thereby permitting the insertion therethrough of the end ear pieces of a stethoscope for use by the wearer, and/or additional ventilation openings as may be desired. By providing a plurality of openings 46, each opening 46 can be made relatively smaller while allowing the same amount of airflow therethrough, thereby maintaining the integrity of the barrier by minimizing the likelihood of a fluid passing through the small openings 46 and contacting the user. The non-front location of the opening 46 prevents fluids from penetrating therethrough into the hood 14. Additionally, the hood 14 may have a brace 48 for supporting the hood 16 away from the wearer's face. It will be understood by those skilled in the art that the hood 14 can be provided by other means for substantially covering a person's head, including a cap with a roll-down face shield, a cap with a flip-down face shield, a cap with a snap-on face shield, or the like.

The hood 14 provides additional benefits by acting as a barrier as to prevent insects, flies, and other disease carrying pests from contacting and possibly infecting the user of the garment system. This is particularly beneficial in environments or situations where insects, flies, and the like proliferate. For example, on emergency relief missions after a hurricane, in hostile climates such as the tropics, or when military or other units recover decayed remains or provide healthcare in the field in the vicinity of decaying human and animal bodies which attract insects, flies, and the like.

There may also be provided at least one coupling 50 capable of detachably connecting the hood 14 to the shirt 12. The coupling 50 may be provided by hook and loop fasteners, snaps, buttons, a zipper, or other means for detachably coupling materials together as are known to those skilled in the art. The hood 14 may be thus be detached from the shirt 12 and stored in one of the pockets 26, 36, 38, or 40 when not in use.

In the use of the garment system, it may be worn as a uniform in the field and in combat situations while providing healthcare treatment and while not, in compliance with the requirements of organizations such as the military. The garments form a generally contiguous full body barrier protecting the wearer from exposure to infectious materials in body fluids, which fluids are often splattered in large quantities on healthcare providers in field and combat situations. The hood 14 may be stored in one of the pockets 26, 36, 38, or 40 when not in use, for example, when eating or socializing but when still required to be in regulation uniform, and then worn when providing healthcare. The hood 14 may then be detached from the shirt 12 at the couplings 50, removed from the wearer's head, and restored in one of the pockets 26, 36, 38, or 40. The garments may be discarded after a single use, or the personal insignia 32 may be removed from the shirt 12 after use and a plurality of shirts 12, pants 10, and hoods 14 can be laundered in bulk and redistributed according to size requests from the healthcare providers without having to sort the garments by the providers' names.

While the invention has been described in connection with certain preferred embodiments, it is not intended to limit the scope of the invention to the particular forms set forth, but, on the contrary, it is intended to cover such alternatives, modifications, and equivalents as may be included within the true spirit and scope of the invention as defined by the appended claims. All patents, applications and publications referred to herein are hereby incorporated by reference in their entirety.

What is claimed is:

1. A barrier garment system, comprising:

a) pants having a waist end;

b) a shirt having a size correlating to a wearer's body size and a lower portion that is capable of overlapping with said pants waist when worn by said wearer, wherein said shirt has organizational insignia fixedly attached to said shirt and personal insignia removably attached to said shirt;

c) a hood having a generally translucent face shield and at least one opening defined in a side, rear, or top portion of said hood; and, d) at least one coupling capable of detachably connecting said hood to said shirt, wherein said pants, shirt, and hood form a generally contiguous barrier protecting said wearer from infectious fluids, and wherein said personal insignia may be removed for bulk laundering of a plurality of said garments.

2. The barrier garment system of claim 1, wherein said hood is capable of substantially covering said wearer's head.

3. The barrier garment system of claim 1, wherein said at least one opening comprises at least two ear openings and at least one ventilation opening.

4. The barrier garment system of claim 1, wherein said generally translucent face shield is made of a generally flexible material.

5. The barrier garment system of claim 1, wherein said hood further comprises a brace capable of supporting said hood away from said wearer's face.

6. The barrier garment system of claim 1, wherein said coupling comprises hook and loop fasteners.

7. The barrier garment system of claim 1, wherein said personal insignia comprise said wearer's name and rank.

8. A garment system for healthcare providers, comprising:

a) pants having a waist;

b) a shirt having a size correlating to a wearer's body size, a lower portion that is capable of overlapping with said pants waist when worn by said wearer, organizational insignia fixedly attached to said shirt, and personal insignia removably attached to said shirt, c) a hood capable of substantially covering said wearer's head, said hood having a generally translucent face shield and at least one opening defined in a side, rear, or top portion of said hood, and at least one coupling capable of detachably connecting said hood to said shirt, wherein said pants and shirt form a generally contiguous barrier protecting said wearer from infectious fluids and said personal insignia may be removed for bulk laundering of a plurality of said garments.

9. A barrier garment system for healthcare providers in a uniformed organization, comprising:

a) pants having a waist;

b) a shirt having a size correlating to a wearer's body size, a lower portion that is capable of overlapping with said pants waist when worn by said wearer, organizational insignia fixedly attached to said shirt, and personal insignia removably attached to said shirt;

c) a hood having a generally translucent face shield made of a generally flexible material and a plurality of openings defined in a side, rear, or top portion of said hood, said openings comprising at least two openings positioned in said hood so as to be generally adjacent said wearer's ears and capable of receiving therethrough of the end ear pieces of a stethoscope; and d) at least one coupling capable of detachably connecting said hood to said shirt, wherein said pants and shirt form a generally contiguous barrier protecting said wearer from infectious fluids and said personal insignia may be removed for bulk laundering of a plurality of said garments.

10. The barrier garment system of claim 9, wherein said hood is capable of substantially covering said wearer's head.

11. The barrier garment system of claim 9, wherein said hood further comprises a brace capable of supporting said hood away from said wearer's face.

12. The barrier garment system of claim 9, wherein said coupling comprises hook and loop fasteners.

13. The barrier garment system of claim 9, wherein said personal insignia comprise said wearer's name and rank.

14. The barrier garment system of claim 9, wherein said pants and said shirt have a camouflaged pattern defined thereon.

15. The barrier garment system of claim 9, wherein said shirt has a strip of a material attached thereto that is capable of being engaged by a clip from a badge.

16. The barrier garment system of claim 9, wherein said shirt has a generally translucent cover sheet attached thereto with at least one open side for removably receiving therein a badge.

17. A barrier garment system for healthcare providers in a uniformed organization, comprising:

a) means for substantially covering a wearer's lower body;

b) means for substantially covering said wearer's upper body;

c) organizational insignia fixedly attached to said upper body covering means;

d) personal insignia removably attached to said upper body covering means;

e) means for substantially covering said wearer's head, where in said head covering means has a generally translucent face shield made of a generally flexible material and a plurality of openings defined in a side, rear, or top portion of said head covering means, said openings comprising at least two ear openings and at least one ventilation opening; and, f) means for detachably connecting said head covering means to said upper body covering means, wherein said lower body covering means, said upper body covering means, and said head covering means forms a generally contiguous barrier protecting said wearer from infectious fluids and said personal insignia may be removed for bulk laundering of a plurality of said garments.

* * * * *